US010684004B2

(12) United States Patent
Tsuda

(10) Patent No.: US 10,684,004 B2
(45) Date of Patent: Jun. 16, 2020

(54) LAMP UNIT

(71) Applicant: KOITO MANUFACTURING CO., LTD., Tokyo (JP)

(72) Inventor: Toshiaki Tsuda, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/424,065

(22) Filed: May 28, 2019

(65) Prior Publication Data

US 2019/0368715 A1 Dec. 5, 2019

(30) Foreign Application Priority Data

May 31, 2018 (JP) ..... 2018-104476

(51) Int. Cl.

| | |
|---|---|
| ***F21S 45/40*** | (2018.01) |
| ***F21V 29/505*** | (2015.01) |
| ***F21V 5/00*** | (2018.01) |
| ***F21V 7/00*** | (2006.01) |
| ***F21V 14/04*** | (2006.01) |

(52) U.S. Cl.

CPC ..... *F21V 29/505* (2015.01); *F21V 5/008* (2013.01); *F21V 7/0083* (2013.01); *F21V 14/04* (2013.01)

(58) Field of Classification Search

CPC ..... F21V 29/505; F21V 5/008; F21V 7/0083; F21V 14/04

See application file for complete search history.

(56) References Cited

U.S. PATENT DOCUMENTS

| | | | | |
|---|---|---|---|---|
| 2014/0036241 | A1* | 2/2014 | Nishimori | F21V 13/04 353/85 |
| 2014/0340909 | A1* | 11/2014 | Yagi | F21S 41/30 362/297 |
| 2015/0085514 | A1* | 3/2015 | Yagi | F21S 41/16 362/538 |
| 2017/0253172 | A1* | 9/2017 | Canonne | B60Q 1/04 |
| 2017/0261173 | A1* | 9/2017 | Suzuki | B60Q 1/08 |
| 2018/0086254 | A1* | 3/2018 | Morel | B60Q 1/0076 |
| 2018/0142856 | A1* | 5/2018 | Reinprecht | G02B 26/0833 |
| 2019/0145599 | A1* | 5/2019 | Kogure | F21S 41/675 362/514 |

FOREIGN PATENT DOCUMENTS

| | | | | |
|---|---|---|---|---|
| EP | 3486211 | A1 * | 5/2019 | B60Q 1/068 |
| JP | 2016-091976 | A | 5/2016 | |

* cited by examiner

*Primary Examiner* — Anabel Ton
(74) *Attorney, Agent, or Firm* — Sughrue Mion, PLLC

(57) ABSTRACT

A lamp unit includes a reflecting device in which a micromirror array is selectively driven to selectively reflect incident light, the micromirror array being an array of micromirrors arranged in a matrix; a projection lens that projects the light selectively reflected by the reflecting device, forward in a light distribution pattern; and a restraining portion configured to restrain external light incident on the projection lens from being condensed in a region other than the micromirror array to restrain an increase in a temperature of the region.

4 Claims, 5 Drawing Sheets

10

LAMP UNIT

INCORPORATION BY REFERENCE

The disclosure of Japanese Patent Application No. 2018-104476 filed on May 31, 2018 including the specification, drawings and abstract is incorporated herein by reference in its entirety.

BACKGROUND

1. Technical Field

The disclosure relates to a lamp unit.

2. Description of Related Art

Japanese Patent Application Publication No. 2016-91976 (JP 2016-91976 A) describes a vehicular lamp in which a reflecting device formed of a micromirror array is provided to reflect light emitted by a light source, the micromirror array being an array of micromirrors arranged in a matrix. The vehicular lamp projects the reflected light forward in a light distribution pattern via a projection lens.

SUMMARY

When daytime sunlight enters the inside of the lamp from the projection lens, the light may be condensed on a component in the lamp, and the component may be eroded, depending on circumstances.

The disclosure provides a novel lamp unit in which occurrence of erosion due to concentration of sunlight is restrained.

A lamp unit according to an aspect of the disclosure includes a reflecting device in which a micromirror array is selectively driven to selectively reflect incident light, the micromirror array being an array of micromirrors arranged in a matrix; a projection lens that projects the light selectively reflected by the reflecting device, forward in a light distribution pattern; and a restraining portion configured to restrain external light incident on the projection lens from being condensed in a region other than the micromirror array to restrain an increase in a temperature of the region.

According to this aspect, it is possible to reduce the possibility that the temperature of the region is increased due the light condensed in the region other than the micromirror array.

The restraining portion may be a shielding member that prevents the external light from being condensed in the region. Thus, the shielding member can restrain the condensation (concentration) of the light in the region. Therefore, for example, the number of materials that can be used for the shielding member is increased, and the structure of the shielding member can be simplified.

The shielding member may be provided between the projection lens and the reflecting device, and the shielding member may be provided with an opening through which the light reflected by the micromirror array travels toward the projection lens. With this configuration, the external light, which is likely to be condensed in the region other than the micromirror array, can be blocked without blocking the light reflected by the micromirror array.

The opening may be smaller than an outer edge of a reflection region in the micromirror array when seen from the projection lens-side. In other words, the opening has such a shape and size that the outer edge of the reflection region in the micromirror array is hidden when the micromirror array is seen through the opening from the projection lens-side. With this configuration, the external light, which is likely to be condensed in the outer edge of the micromirror array, can be blocked.

The restraining portion may be a reflective member that is provided around the micromirror array. With this configuration, if the external light reaches a region around the micromirror array, the external light is reflected by the region around the micromirror array. Thus, it is possible to restrain an increase in the temperature of the region around the micromirror array.

The restraining portion may be a light guide configured to guide the external light that has passed through the projection lens to a reflective surface of the micromirror array. With this configuration, since the external light is guided by the light guide, an optical path of the external light is controlled to be in a specified area. Thus, the external light is unlikely to be condensed in the region around the micromirror array.

Any combination of components described so far, and a method, a device, a system and the like, which are provided by changing the expression of the disclosure, are also effective as aspects of the disclosure.

According to the disclosure, it is possible to restrain the occurrence of erosion due to concentration of sunlight.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
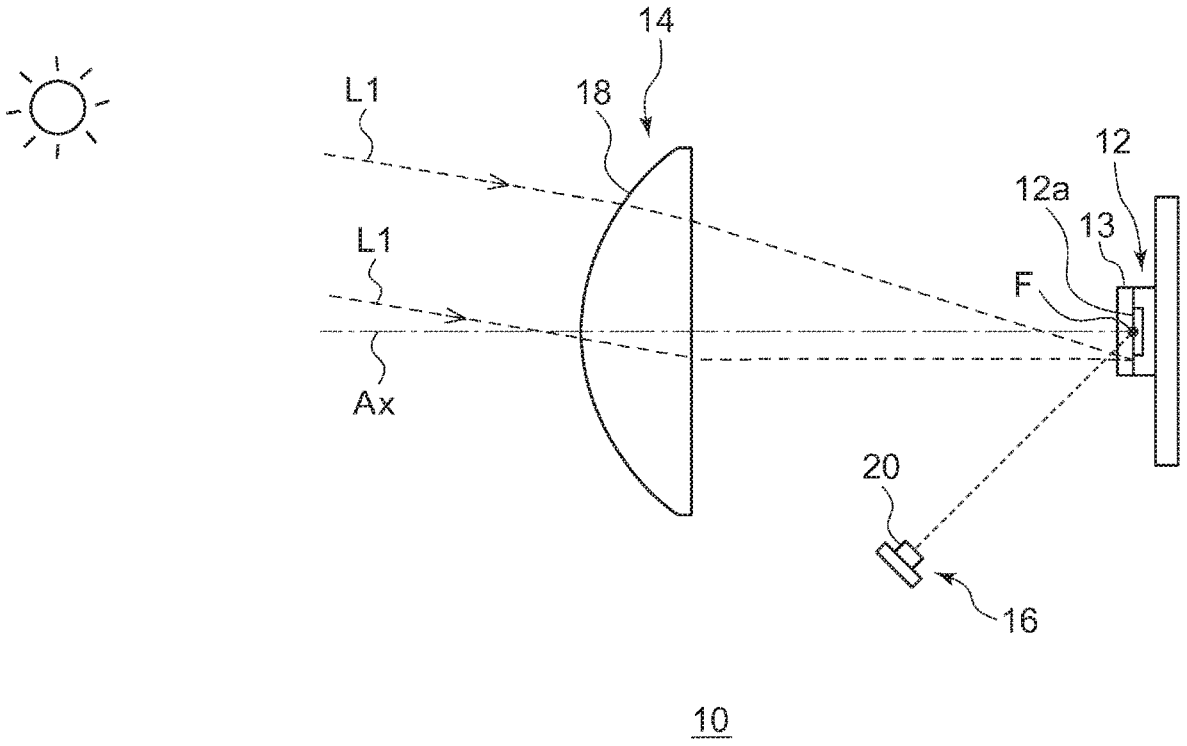
FIG. 1 is a side view showing a schematic configuration of a lamp unit according to a first embodiment.

A description will hereinafter be provided on embodiments of the disclosure with reference to the drawings. The same or equivalent constituent elements, members, and processing shown in the drawings will be denoted by the same reference numerals, and the description thereof will not be repeated. The embodiments are illustrative and not restrictive, and thus, the disclosure is not limited to the embodiments.

A first embodiment will be described. FIG. 1 is a side view showing a schematic configuration of a lamp unit according to the first embodiment. A lamp unit 10 according to the first embodiment is mainly used as a vehicular lamp (for example, a vehicular headlamp). However, the application of the lamp unit 10 is not limited thereto. The lamp unit 10 can be also applied to a lamp for any of various illuminating devices and various moving bodies (an airplane, a rail vehicle, and the like).

The lamp unit 10 includes a reflecting device 12 configured to selectively reflect incident light (i.e., light incident on the reflecting device 12); a projection optical system 14 configured to project the light selectively reflected by the reflecting device 12, forward in a light distribution pattern; and a radiation optical system 16 configured to radiate the light to a reflection region 12*a* of the reflecting device 12. The reflection region 12*a* is sealed by a transparent plate-shaped member 13 such as glass.

The projection optical system 14 includes a projection lens 18. The radiation optical system 16 includes a light source 20. As the light source 20, a semiconductor light-emitting element such as a light-emitting diode (LED), a laser diode (LD), or an electroluminescence (EL) element, a light bulb, an incandescent lamp (a halogen lamp), a discharge lamp, or the like can be used. Note that, depending on an emission color required of the light source 20, a fluorescent body may be used in combination when necessary. For example, the light source 20 is mounted on a desired position in a heat sink that is made of metal, ceramic, or the like.

In addition, with regard to the radiation optical system 16, a light condensing member (a condenser lens or a condenser mirror) or a reflective member (a reflector) may be disposed in an optical path from the light source 20 to the reflecting device 12 in accordance with size (a layout) and/or performance (light distribution) required of the lamp unit 10.

The light condensing member is configured to guide most part of the light emitted by the light source 20 to the reflection region 12*a* of the reflecting device 12. For example, as the light condensing member, a convex lens, a solid light guide in a bombshell shape, a reflection mirror whose inner surface is formed as a specified reflective surface, or the like is used. More specifically, a compound parabolic concentrator is exemplified as the light condensing member. In the case where the most part of the light emitted by the light source 20 can be guided to the reflection region 12*a* of the reflecting device 12, the light condensing member may not be used.

The reflecting device 12 is disposed on an optical axis Ax behind the projection optical system 14 and is configured to selectively reflect the light emitted by the light source 20 to the projection optical system 14. The reflecting device 12 is configured as, for example, a microelectromechanical system (MEMS) or a digital mirror device (DMD) that is formed by arranging a plurality of micromirrors in an array (a matrix). When angles of reflective surfaces of the plurality of micromirrors in the array are subjected to selective drive control (i.e., when the plurality of micromirrors in the array are selectively driven such that the angles of the reflective surfaces of the micromirrors are selectively changed), the light incident on the reflection region 12*a* is selectively reflected toward the projection lens 18.

Thus, the reflecting device 12 can selectively change a reflection direction of the light emitted by the light source 20 (i.e., a direction in which the light emitted by the light source 20 is reflected) to a specified direction. That is, the reflecting device 12 can reflect a portion of the light emitted by the light source 20 toward the projection optical system 14 and reflect the rest of the light in a direction in which the light is not effectively used.

In the lamp unit 10 according to the first embodiment, the micromirror array, which will be described below, in the reflecting device 12 is disposed at and in the vicinity of a focus of the projection lens 18. Note that the projection optical system 14 may include a plurality of optical members such as the projection lenses. In addition, the optical member provided in the projection optical system 14 is not limited to the lens, and may be a reflective member.

The lamp unit 10, which is configured as described above, can be used for a variable light distribution headlamp that can be partially lighted and partially unlighted.

Figure 2A:
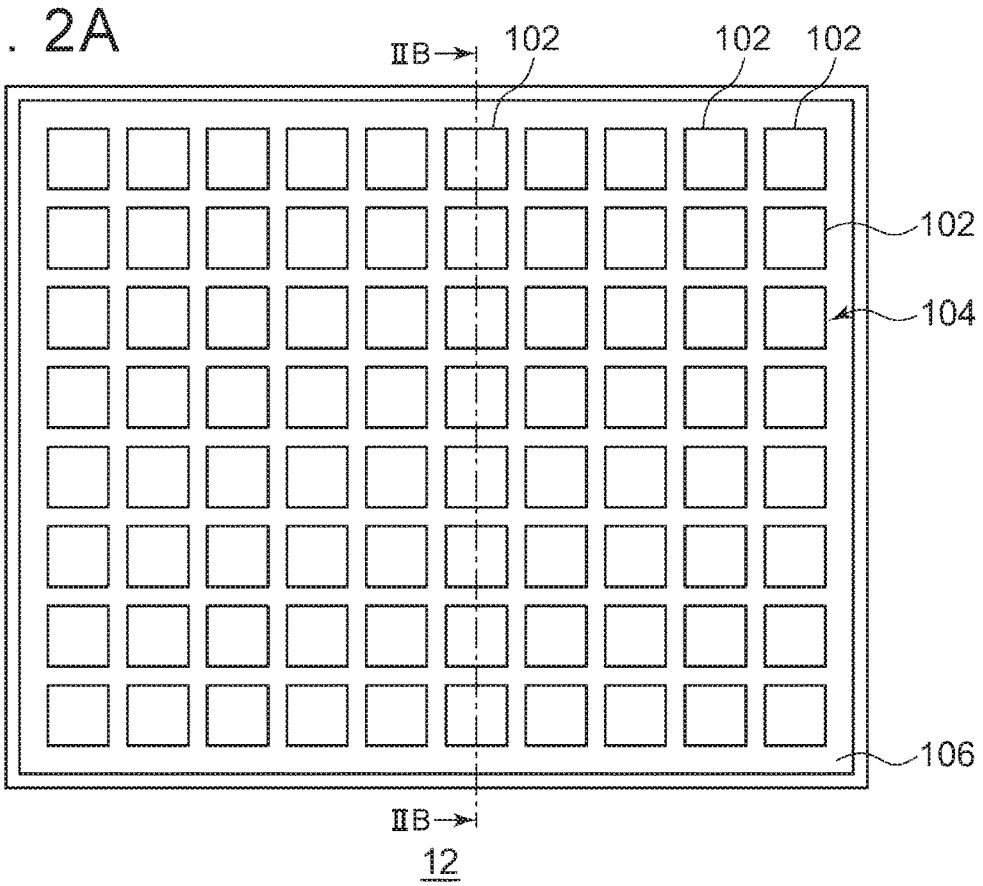
FIG. 2A is a front view showing a schematic configuration of a reflecting device.
Figure 2B:
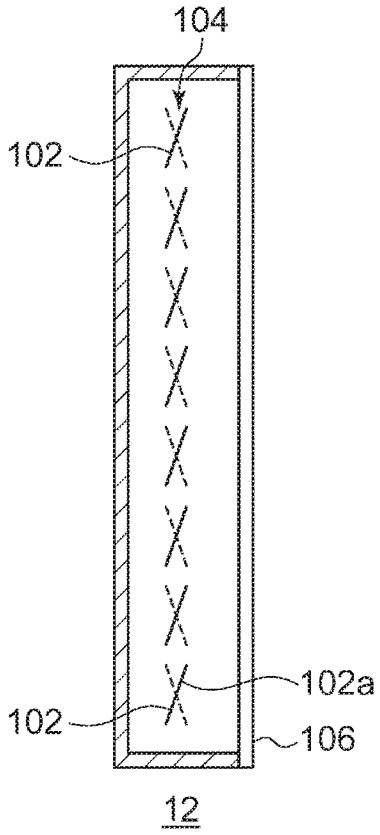
FIG. 2B is a cross-sectional view of the reflecting device that is taken along IIB-IIB in FIG. 2A.

FIG. 2A is a front view showing a schematic configuration of the reflecting device 12, and FIG. 2B is a cross-sectional view of the reflecting device 12 that is taken along IIB-IIB in FIG. 2A.

As shown in FIG. 2A, the reflecting device 12 includes a micromirror array 104 in which a plurality of small mirror elements (micromirror elements) 102 are arranged in a matrix; and a transparent cover member 106 disposed in front of reflective surfaces 102*a* of the mirror elements 102 (i.e., the transparent cover member 106 disposed on a right side of the reflecting device 12 shown in FIG. 2B). The cover member 106 is made of glass or plastic, for example, and may also serve as the transparent plate-shaped member 13 described above.

The position of each of the mirror elements 102 in the micromirror array 104 is switchable between a first reflective position P1 (a position indicated by a solid line in FIG. 2B) where the mirror element 102 reflects the light emitted by the light source 20 toward the projection optical system 14 such that the light emitted by the light source 20 is effectively used as a part of the desired light distribution pattern and a second reflective position P2 (a position indicated by a dotted line in FIG. 2B) where the mirror element 102 reflects the light emitted by the light source 20 such that the light emitted by the light source 20 is not effectively used.

As shown in FIG. 1, in the lamp unit 10 configured as described above, the reflecting device 12 is disposed at and in the vicinity of a focus F of the projection lens 18 in consideration of light distribution performance and resolution. Thus, when external light L1 such as sunlight is incident on the projection lens 18 (i.e., the external light L1 enters the projection lens 18) at a relatively small angle with respect to the optical axis Ax, the light may be condensed at a position offset from the focus F of the projection lens 18. In the case of the projection optical system 14 with a small depth of field, the external light is unlikely to be condensed at one point (in a small area) when the external light is condensed at the position slightly offset from the focus F. Thus, an influence of erosion is relatively small.

Meanwhile, the reflection region 12*a* of the reflecting device 12 according to the first embodiment is a relatively large rectangular region that is formed of the micromirror array 104 and has one side of approximately 5 to 15 mm. Accordingly, in the case where the projection optical system 14 is formed of one single-focus projection lens 18, a peripheral edge of a light source image is not formed (is defocused) when the light source image is formed by the light selectively reflected by the reflection region 12*a* and projected forward by the projection optical system 14. Thus, by combining a plurality of lenses, an entire region of the light source image can be formed, the light source image being produced by the light reflected by the reflection region 12*a*.

Figure 3:
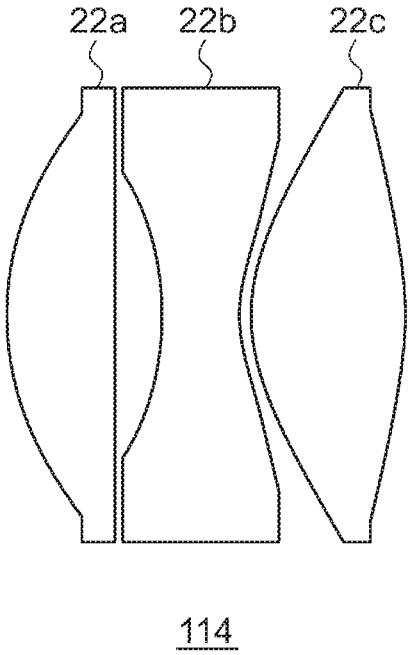
FIG. 3 is a view showing a projection optical system according to a modified example of the first embodiment.

FIG. 3 is a view showing a projection optical system according to a modified example of the first embodiment. A projection optical system 114 shown in FIG. 3 includes three lenses 22*a*, 22*b*, 22*c*. By appropriately combining shapes and/or materials of the lenses, the projection optical system with high imaging performance is realized. Accordingly, the entire light source image including the peripheral edge is formed (is not defocused) when the light source image is formed by the light selectively reflected by the reflection region 12*a* and is projected forward by the projection optical system 114. More specifically, the projection optical system 114 can form the light source image in a range of a focal distance ±0.2 mm in an optical axis direction.

Figure 4:
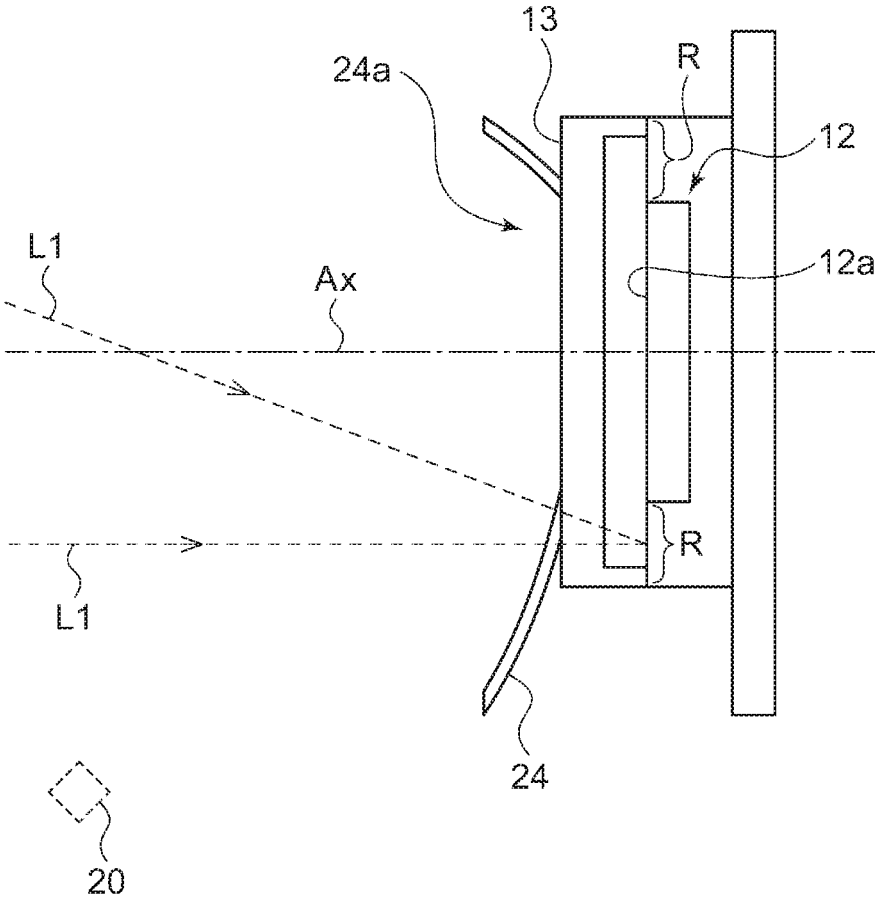
FIG. 4 is a schematic view in which the reflecting device and a portion in the vicinity of the reflecting device are enlarged to illustrate a restraining portion according to the first embodiment.
Figure 5:
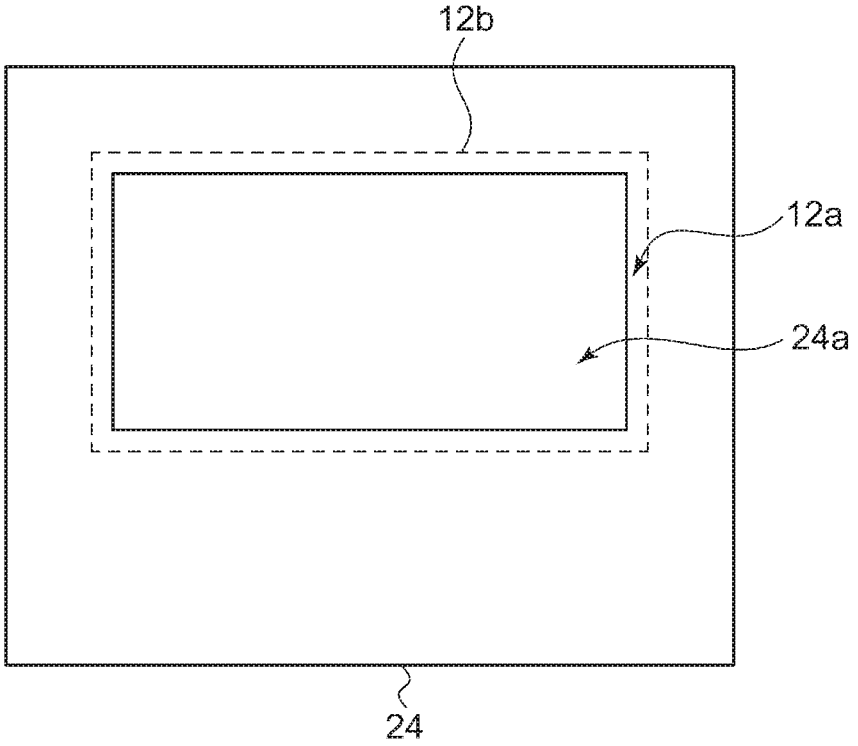
FIG. 5 is a front view of a shielding member according to the first embodiment.

When the range in which the image can be formed is increased, the external light L1 incident on the projection lenses is likely to be also condensed (focused) in a region around the reflection region 12*a* of the reflecting device 12, and the region may be eroded. In view of the above, the lamp unit 10 according to the first embodiment includes a restraining portion that restrains the external light incident on the projection lens (or the projection lenses) from being condensed in a region other than the micromirror array so as to restrain an increase in a temperature of such a region. FIG. 4 is a schematic view in which the reflecting device 12 and a portion in the vicinity of the reflecting device 12 are enlarged to illustrate the restraining portion according to the first embodiment. FIG. 5 is a front view of a shielding member according to the first embodiment.

As shown in FIG. 4, when the external light L1 is condensed in a region R other than the reflection region 12*a*, the region R may be eroded. Thus, in this embodiment, a shielding member 24 that prevents the external light L1 from being condensed in the region R is provided as an erosion restraining portion (in other words, a restraining portion). Thus, it is possible to reduce the possibility that the temperature of the region R is increased due to the light condensed in the region R other than the reflection region 12*a* where the micromirror array is disposed. Further, since the shielding member 24 can restrain the condensation (concentration) of light in the region R, for example, the number of materials that can be used for the shielding member 24 is increased, and the structure of the shielding member 24 can be simplified. For example, a heat-resistant member such as ceramic or metal may be used as the shielding member 24. In addition, a metallic reflection film that is made of aluminum or copper, or a light absorbing film in which a plurality kinds of metallic films are stacked in a plurality of layers may be formed on a surface of the shielding member 24.

The shielding member 24 is provided between the projection lens 18 (or the projection lenses 22*a*, 22*b*, 22*c*) and the reflecting device 12. As shown in FIG. 5, the shielding member 24 is provided with an opening 24*a* through which the light reflected by the micromirror array (the reflection region 12*a*) travels toward the projection lens 18 (or the projection lenses 22*a*, 22*b*, 22*c*). Thus, the external light L1, which is likely to be condensed in the region R other than the micromirror array, can be blocked without blocking the light reflected by the micromirror array.

The opening 24*a* is smaller than an outer edge 12*b* of the reflection region 12*a* in the micromirror array when seen from the projection lens-side. In other words, the opening 24*a* has such a shape and size that the outer edge 12*b* of the reflection region 12*a* in the micromirror array is hidden when the micromirror array is seen through the opening 24*a* from the projection lens-side. Thus, the external light L1, which is likely to be condensed in the outer edge 12*b* of the micromirror array, can be blocked.

Figure 6:
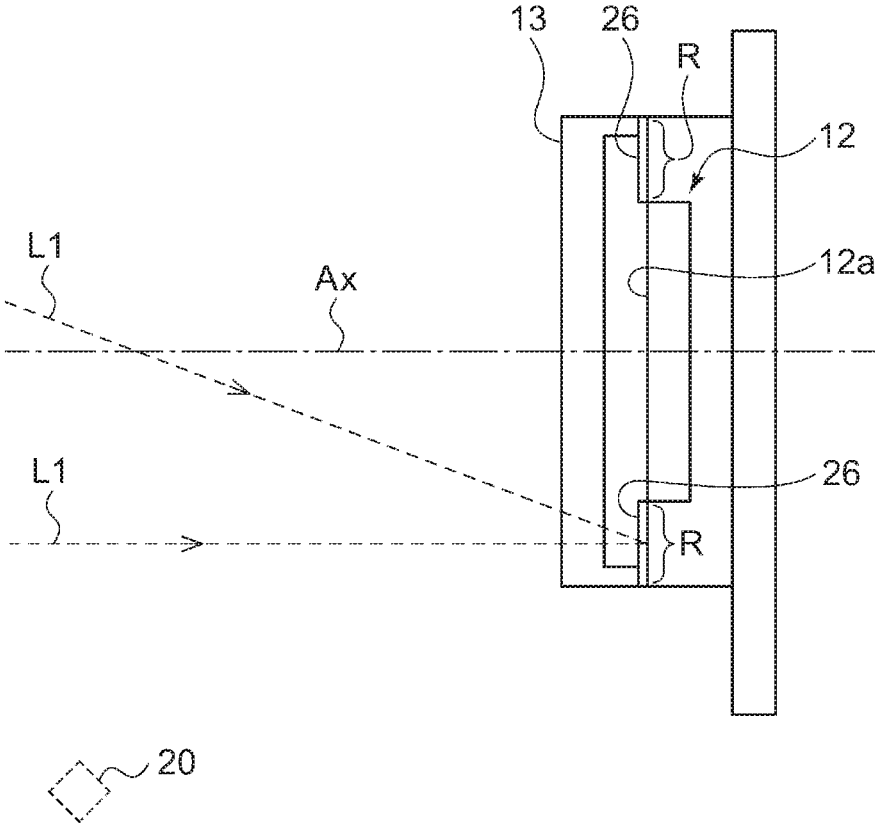
FIG. 6 is a schematic view in which a reflecting device and a portion in the vicinity of the reflecting device are enlarged to illustrate a restraining portion according to a second embodiment.

A second embodiment will be described. FIG. 6 is a schematic view in which the reflecting device 12 and a portion in the vicinity of the reflecting device 12 are enlarged to illustrate a restraining portion according to the second embodiment. The erosion restraining portion according to the second embodiment is a reflective member 26 that is provided around the reflection region 12*a* where the micromirror array is disposed. Thus, if the external light L1 reaches the region R around the reflection region 12*a* where the micromirror array is disposed, the external light L1 is reflected by the reflective member 26 provided in the region R around the reflection region 12*a*. Therefore, it is possible to restrain an increase in the temperature of the region R. For example, a metallic reflection film made of aluminum or copper may be used as the reflective member 26. Alternatively, a light shielding member (i.e., a light blocking member) that absorbs the external light L1 may be provided instead of the reflective member 26. The reflective member 26 or the light shielding member may be formed on a reverse surface of the plate-shaped member 13 in advance, and then may be joined to a region around the reflection region 12*a* of the reflecting device 12.

Figure 7A:
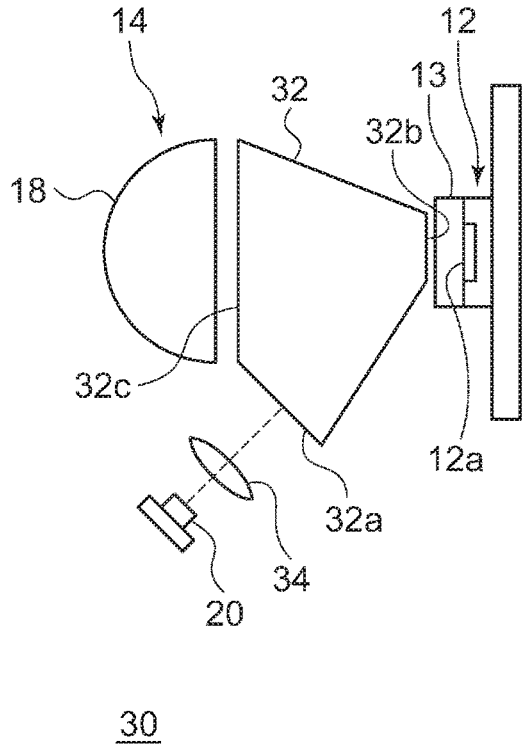
FIG. 7A is a view showing a schematic configuration of a lamp unit according to a third embodiment.

A third embodiment will be described. FIG. 7A is a view showing a schematic configuration of a lamp unit according to the third embodiment, and FIG. 7B is a view showing a schematic configuration of a lamp unit according to a modified example of the third embodiment.

A lamp unit 30 shown in FIG. 7A significantly differs from the lamp unit 10 according to the first embodiment in that a light guide 32 is disposed between the projection lens 18 and the reflecting device 12. The light guide 32 includes an incident portion 32*a* on which the light emitted by the light source 20 is incident after being condensed by a light condensing member 34; an incident portion 32*b* on which the light reflected by the reflecting device 12 is incident; and an emission portion 32*c* from which the reflected light guided through the light guide 32 is emitted. The light guide 32 is a translucent member that is made of glass, plastic, or the like, and surfaces other than surfaces of the incident portions 32*a*, 32*b* and the emission portion 32*c* are coated with a reflection film or a light shielding film (i.e., a light blocking film). Thus, the light guide 32 can efficiently guide the light emitted by the light source 20 to the projection optical system 14.

In addition, the light guide 32 includes the incident portion 32*b* having the substantially same size as the size of the reflection region 12*a*, the incident portion 32*b* being provided at a position facing the reflection region 12*a*. Thus, the external light L1 that has passed through the projection lens 18 is guided to the reflection region 12*a* where the micromirror array is disposed, and is not condensed in a region other than the reflection region 12*a*. Thus, since the external light L1 is guided by the light guide 32, the optical path of the external light L1 is controlled to be in a specified area. Thus, the external light L1 is unlikely to be condensed in a region around the reflection region 12*a* where the micromirror array is disposed.

Figure 7B:
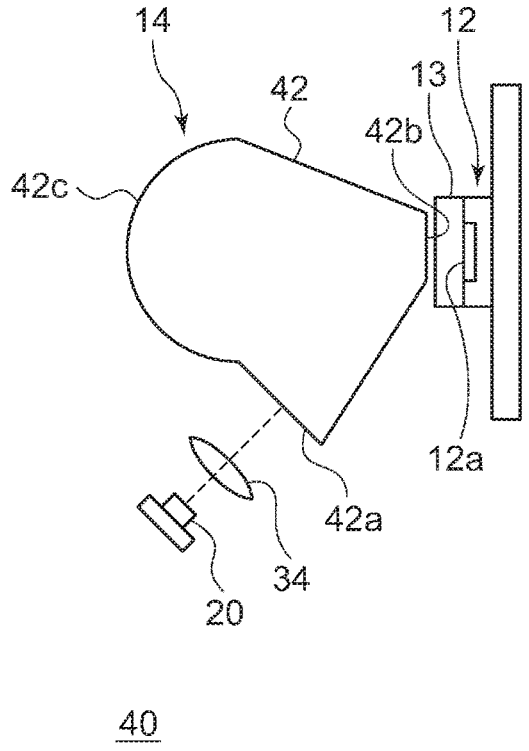
FIG. 7B is a view showing a schematic configuration of a lamp unit according to a modified example of the third embodiment.

A lamp unit 40 shown in FIG. 7B significantly differs from the lamp unit 30 according to the third embodiment in that a light guide is integrated with a projection lens. A light guide 42 of the lamp unit 40 includes an incident portion 42*a* on which the light emitted by the light source 20 is incident after being condensed by the light condensing member 34;

an incident portion 42*b* on which the light reflected by the reflecting device 12 is incident; and a projection portion 42*c* from which the reflected light guided through the light guide 42 is refracted and emitted. The light guide 42 is a translucent member that is made of glass, plastic, or the like, and surfaces other than surfaces of the incident portions 42*a*, 42*b* and the projection portion 42*c* are coated with a reflection film or a light shielding film (i.e., a light blocking film). Thus, the light guide 42 can efficiently project the light emitted by the light source 20.

The description has been provided so far on the disclosure with reference to each of the above-described embodiments. However, the disclosure is not limited to each of the above-described embodiments and includes embodiments in which the configurations in the above-described embodiments are appropriately combined or replaced. It is possible to appropriately change the combination or a processing order in each of the embodiments, and to make various design changes to each of the embodiments, on the basis of knowledge of a person skilled in the art. The embodiments, to which such modifications are added, can be also included in the scope of the disclosure.

What is claimed is:

1. A lamp unit comprising:

a reflecting device in which a micromirror array is selectively driven to selectively reflect incident light, the micromirror array being an array of micromirrors arranged in a matrix;

a projection lens that projects the light selectively reflected by the reflecting device, forward in a light distribution pattern; and a restraining portion configured to restrain external light incident on the projection lens from being condensed in a region other than the micromirror array to restrain an increase in a temperature of the region, wherein the restraining portion is a shielding member that prevents the external light from being condensed in the region, wherein the shielding member is provided between the projection lens and the reflecting device, and the shielding member is provided with an opening through which the light reflected by the micromirror array travels toward the projection lens, and wherein the opening is smaller than an outer edge of a reflection region in the micromirror array when seen from the projection lens-side.

2. The lamp unit according to claim 1, wherein the restraining portion is a reflective member that is provided around the micromirror array.

3. The lamp unit according to claim 1, wherein the restraining portion is a light guide configured to guide the external light that has passed through the projection lens to a reflective surface of the micromirror array.

4. A lamp unit comprising:

a reflecting device in which a micromirror array is selectively driven to selectively reflect incident light, the micromirror array being an array of micromirrors arranged in a matrix;

a projection lens that projects the light selectively reflected by the reflecting device, forward in a light distribution pattern; and a restraining portion configured to restrain external light incident on the projection lens from being condensed in a region other than the micromirror array to restrain an increase in a temperature of the region, wherein the restraining portion is a light guide configured to guide the external light that has passed through the projection lens to a reflective surface of the micromirror array.

* * * * *